US005745996A

United States Patent [19]

Kenny et al.

[11] Patent Number: 5,745,996

[45] Date of Patent: May 5, 1998

[54] SHEATHING CUTTING DEVICE

[75] Inventors: Daniel P. Kenny, Richmond; Donald J. Singer, Langley; Gerhard G. Kast, Abbotsford, all of Canada

[73] Assignee: Dyckerhoff & Widmann AG of Munich, Munich, Germany

[21] Appl. No.: 635,037

[22] Filed: Apr. 17, 1996

Related U.S. Application Data

[63] Continuation of Ser. No. 349,045, Dec. 2, 1994, abandoned.

[51] Int. Cl.[6] ..... B26B 27/00; H02G 1/12

[52] U.S. Cl. ..... 30/90.1; 83/745; 83/924; 83/947; 81/9.4; 52/749.1

[58] Field of Search ..... 52/749.1, 223.13, 52/223.14; 83/947, 924, 743, 745; 30/90.1, 91.2; 29/426.4, 426.5, 412; 81/9.4, 9.41, 9.43, 9.44

[56] References Cited

U.S. PATENT DOCUMENTS

| | | | |
|---|---|---|---|
| 853,969 | 5/1907 | Goebler | 83/924 X |
| 1,801,706 | 4/1931 | Westfall . | |
| 1,841,251 | 1/1932 | Miller | 83/924 X |
| 2,120,398 | 6/1938 | Edwards et al. | 30/91.2 |
| 2,187,215 | 1/1940 | Spinello | 30/91 |
| 2,385,368 | 9/1945 | Montgomery | 30/91 |
| 2,525,097 | 10/1950 | Hasler et al. | 83/924 X |
| 2,695,537 | 11/1954 | Imman et al. | 81/9.5 |
| 2,735,320 | 2/1956 | Green | 81/9.43 |
| 2,787,177 | 4/1957 | Frye | 81/9.5 |
| 3,161,088 | 12/1964 | Tolman | 81/9.5 |
| 3,535,785 | 10/1970 | Matthews | 30/91.2 |
| 3,628,402 | 12/1971 | Staiger | 81/9.5 R |
| 3,851,687 | 12/1974 | Jones | 30/90.1 |
| 4,116,092 | 9/1978 | Wheeler | 30/90.1 |
| 4,117,749 | 10/1978 | Economu | 81/9.5 R |
| 4,227,431 | 10/1980 | Wells | 29/426.4 X |
| 4,368,654 | 1/1983 | Kober et al. | 30/90.1 |
| 4,426,778 | 1/1984 | Christie | 30/90.1 |
| 4,447,949 | 5/1984 | Kane | 83/924 X |
| 4,509,257 | 4/1985 | Moriyama | 83/924 X |
| 4,543,717 | 10/1985 | Luka | 30/90.6 |
| 4,557,163 | 12/1985 | Tanner | 81/9.44 |
| 4,688,707 | 8/1987 | Szostak et al. | 225/2 |
| 4,741,104 | 5/1988 | Noon | 81/9.41 |
| 4,839,986 | 6/1989 | Grantham | 30/90.4 X |
| 4,858,315 | 8/1989 | Tanner | 30/90.4 |
| 4,918,887 | 4/1990 | Davis et al. | 52/223.13 |
| 5,074,043 | 12/1991 | Mills | 30/90.1 |
| 5,263,291 | 11/1993 | Knight | 52/223.13 |
| 5,347,777 | 9/1994 | Sudduth | 52/223.13 |
| 5,438,753 | 8/1995 | Stepan | 30/90.1 |
| 5,632,088 | 5/1997 | Naso et al. | 30/91.2 |

FOREIGN PATENT DOCUMENTS

| | | | |
|---|---|---|---|
| 1290240 | 10/1991 | Canada . | |
| 2113293 | 9/1994 | Canada . | |
| 2493619 | 5/1982 | France | 30/90.1 |
| 3904323 | 8/1990 | Germany | 30/90.1 |

*Primary Examiner*—Rinaldi I. Rada
*Assistant Examiner*—Charles Goodman
*Attorney, Agent, or Firm*—Marshall, O'Toole, Gerstein, Murray & Borun

[57] ABSTRACT

A device for cutting sheathing from a tendon extending through an anchor assembly includes a housing adapted to be rotatable about the sheathed tendon and a blade having a cutting edge. The blade cutting edge is oriented in a selected cutting position within the anchor assembly when the housing is mounted on the sheathed tendon and rotated thereabout.

16 Claims, 4 Drawing Sheets

23
31
51
33
55
43
45
93
77
67
35
29
25
59
97
98
61
37
39
41
81
99
73
71
65
63
57
53
121
127
129
123
119
125
131

SHEATHING CUTTING DEVICE

This is a continuation of U.S. application Ser. No. 08/349,045, filed Dec. 2, 1994, now abandoned.

BACKGROUND OF THE INVENTION

1. Field of the Invention

The present invention relates generally to devices employed in the process of stressing structural tension and compression members, and in particular to devices for cutting sheathing from a tendon disposed in a structure prior to the application of a tractive force thereon.

2. Description of Related Technology

Structures, such as those made from concrete, may be reinforced or strengthened by utilizing post-tensioning tendons. This type of reinforcement typically comprises one or more high tensile strength tendons which are tensioned after a hardening material (e.g., concrete) is poured and allowed to harden thereabout. Tendons may also be used to strengthen steel structures, such as trusses, for rock and soil anchors and other tension applications.

Tendons are often provided with a plastic covering or sheathing, often made of polyethylene. Usually, the space between the tendon and the sheathing is filled with grease or grease-like compounds such as microcrystalline wax. The grease-filled sheathing performs the dual function of protecting the tendon from corrosion and allowing the tendon to move freely, even within hardened concrete.

When a sheathed tendon is utilized to reinforce or strengthen a concrete structure, for example, via a post-tensioning process, typically the sheathed tendon is placed at the site of the structure and held loosely in position suspended between two anchorage bodies or assemblies while concrete is placed therearound. After the concrete hardens, a tensioning device, such as a hydraulic jack, is attached at one end of the tendon and is actuated to apply a predetermined amount of tension to the tendon. Once the desired amount of tension is applied, locking wedges or other holding means are lodged between the tendon and the anchorage body or assembly to grip the tendon and retain it at the desired tension. The hydraulic jack is then removed.

The plastic sheathing must be removed from the end of a tendon prior to tensioning so that the locking jaws of the tensioning device and the locking wedges can directly contact and grip the tendon. Typically, sheathing removal has been performed before the tendon is inserted in the anchorage assemblies, usually well before the pouring of concrete into the structure. In practice, an unsheathed tendon end may be exposed to the elements from several days to several weeks before the tendon is tensioned, allowing corrosion of the tendon to occur.

An alternative to the foregoing is to remove the sheathing after the tendon is inserted into the anchorage assemblies. However, due to the need to remove the sheathing at locations disposed within an anchorage assembly and the limited space within such assemblies, such removal can prove difficult at best.

SUMMARY OF THE INVENTION

It is an object of the invention to overcome one or more of the problems described above.

According to the invention, a device for cutting sheathing from a tendon which is disposed in an anchor assembly includes a blade support and a blade having a cutting edge. When the device is mounted on a sheathed tendon, the cutting edge contacts the sheathing. The cutting edge cuts the sheathing at a selected location within the anchor assembly when the blade support is rotated about the tendon.

In accordance with a specific aspect of the invention, the blade support includes a housing for mounting on a portion of the tendon in rotatable fashion and a mechanism for securing the blade to the housing. When the device is mounted on a sheathed tendon, the blade contacts an inner wall of the anchor assembly and deflects the cutting edge toward the tendon into contact with the sheathing. The cutting edge cuts the sheathing at a selected location when the housing is rotated about the tendon.

Also in accordance with a specific aspect of the invention, the housing of the device includes features such as an inner surface defining an opening. The inner surface partially surrounds the sheathed tendon when the device is mounted thereon.

Another housing feature is a forward portion having a conical outer surface. When the device is mounted on the tendon, the conical surface contacts the anchor assembly inner wall to provide coaxial alignment between the housing and the tendon. Furthermore, the housing may include a substantially cylindrical portion attached to the forward portion with the blade securing mechanism being disposed within this cylindrical portion.

Preferably, the blade securing mechanism is a blade holding and extending mechanism having first and second positions. When the mechanism is in the first position, the blade cutting edge is disposed within the housing. When the mechanism is in the second position, the blade cutting edge extends outside of the housing and is in a cutting position.

Also in accordance with the preferred embodiment, the housing of the device includes a forward portion having a slot through which the blade extends when the mechanism is in the second position.

The mechanism also preferably automatically converts from the second position to the first position when the device is removed from the tendon.

In particular, an embodiment of the blade holding and cutting mechanism includes first and second arms connected by a tension spring with the spring drawing the first arm toward the second arm. The first arm is pivotally attached to the housing and the second arm is pivotally attached to the first arm and to a blade holder slidingly mounted on the housing The blade is fixed to the blade holder.

In accordance with a specific aspect of the embodiment, at least one of the first and second arms abuts the sheathed tendon expanding the spring and displacing the blade to the selected cutting position when the blade holding and extending mechanism is in the second position.

Further in accordance with this specific aspect of the invention, the blade holder includes first and second flanges and the housing has first and second grooves with the first and second flanges being slidingly disposed within the first and second grooves, respectively.

Also, a device according to the invention for cutting sheathing which envelopes a tendon includes a housing for mounting on a portion of the tendon in rotatable fashion, a blade having a cutting edge, and a mechanism for securing the blade to the housing. When the device is mounted on a sheathed tendon, the blade contacts an inner wall of the anchor assembly and deflects the cutting edge toward the tendon into contact with the sheathing. The cutting edge cuts the sheathing at a selected location when the housing is rotated about the tendon.

Still further, a device according to the invention for cutting sheathing which envelops a tendon includes a substantially cylindrical housing for mounting on a portion of a sheathed tendon in rotatable fashion, the tendon being inserted in an anchor assembly. The housing includes an inner surface defining an opening. The inner surface partially surrounds the sheathed tendon when the device is mounted on the tendon. The device further includes an elongate blade having a surface and a cutting edge, and a blade holding and extending mechanism mounted on the housing and fixed to the blade. The mechanism has a first position wherein the blade cutting edge is disposed within the housing and a second position wherein the blade cutting edge extends outside of the housing and is in a selected cutting position. When the device is mounted on the sheathed tendon, the mechanism is in the second position and the blade surface contacts an inner wall of the anchor assembly thereby deflecting the cutting edge toward the tendon into contact with the sheathing. The cutting edge cuts the sheathing at a selected location as the housing is rotated about the tendon.

A method according to the invention for cutting a sheathed tendon disposed in an anchor body or assembly includes the steps of providing a device having a housing for mounting on a sheathed tendon in rotatable fashion and a blade having a cutting edge. The device is placed on the sheathed tendon near the anchor assembly and slid along the sheathed tendon toward the anchor assembly until the cutting edge is disposed within the anchor body or assembly at a selected location. The housing of the device is then rotated about the sheathing with the cutting edge severing the sheathing at the selected location.

In accordance with a specific aspect of a method according to the invention, when the device is slid along the sheathed tendon toward the anchor assembly, the blade of the device contacts an inner wall of the anchor assembly and deflects the cutting edge toward the tendon into contact with the sheathing and the cutting edge pierces the sheathing. The housing of the device is then rotated about the sheathing causing the cutting edge to sever the sheathing.

In accordance with a further method according to the invention for cutting sheathing which envelops a tendon, a device is provided having a substantially cylindrical housing for mounting on a portion of a sheathed tendon in rotatable fashion, the housing having an inner surface defining an opening. The device includes an elongate blade having a surface and a cutting edge, and a blade holding and extending mechanism mounted on the housing and fixed to the blade. The mechanism has a first position wherein the blade cutting edge is disposed within the housing and a second position wherein the blade cutting edge extends outside of the housing and is in a selected cutting position. When the device is mounted on a sheathed tendon which is inserted in an anchor assembly, the blade surface contacts an inner wall of an anchor assembly and deflects the cutting edge toward the sheathed tendon, piercing the sheathing when a forward portion of the housing abuts against the anchor assembly. The device is mounted onto a sheathed tendon until the inner surface of the device partially surrounds a portion of the tendon near an anchor assembly and the mechanism is in the second position. The device is then slid along the sheathed tendon toward the anchor assembly until the forward housing portion abuts an end of the anchor assembly. The housing of the device is rotated about the sheathing (with the cutting edge severing the sheathing), slid away from the anchor assembly and removed from the tendon. The sheathing which has been cut by the cutting edge of the blade is slid along the tendon in a direction toward an end of the tendon and away from the anchor assembly and removed from the end of the tendon.

Other objects and advantages of the invention will be apparent to those skilled in the art from the following detailed description taken in conjunction with the drawings and the appended claims.

DETAILED DESCRIPTION OF THE INVENTION

Figure 1:
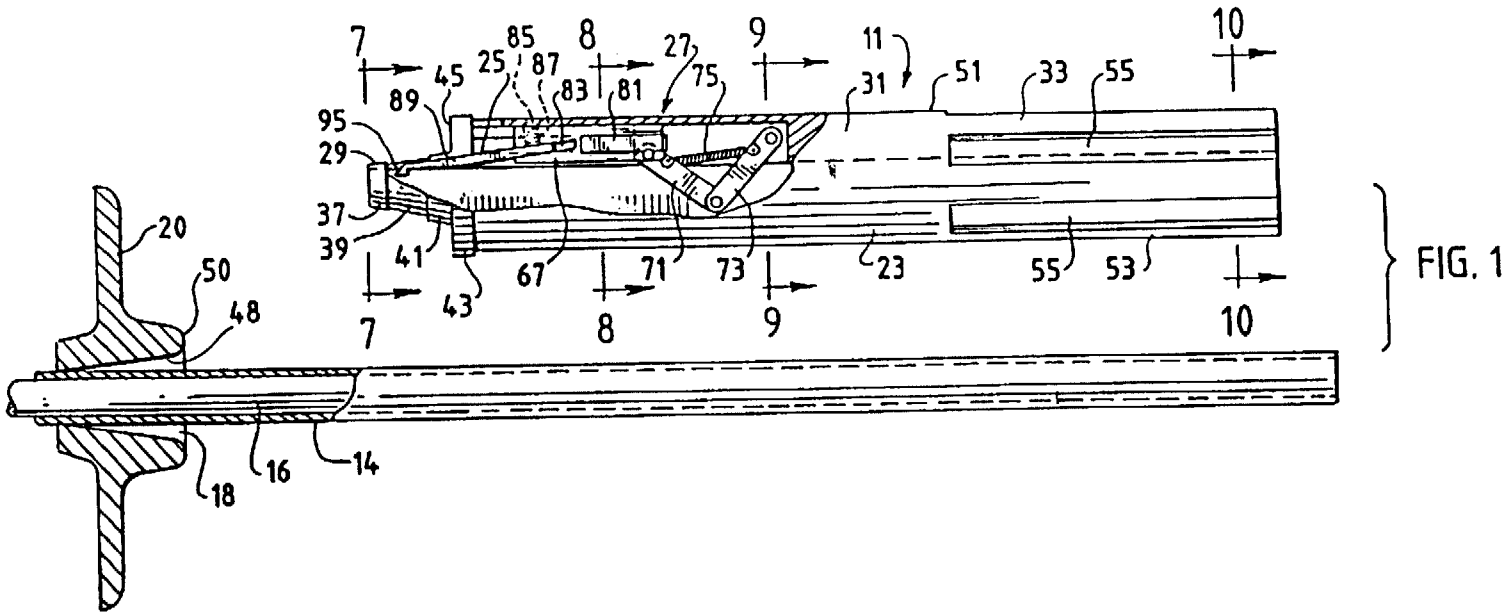
FIG. 1 is a side elevational view, partially in section, of a sheathing cutting device according to the present invention together with a sheathed tendon inserted in an anchor.

With reference to FIGS. 1–10, a device generally designated 11 according to the present invention for cutting sheathing 14 from a post-tensioning tendon 16 disposed in a wedge cavity 18 of an anchor assembly 20 generally comprises means for supporting the blade illustrated by an elongate housing 23, a blade 25 and further support means for holding the blade 25 illustrated by a blade holding and extending mechanism generally designated 27. A "tendon" as described herein includes both single-strand and multi-strand tendons which may be utilized in a variety of applications in addition to the reinforcing or strengthening of concrete structures. Such applications include, but are limited to, rock and soil anchors and tension-ties.

Figure 2:
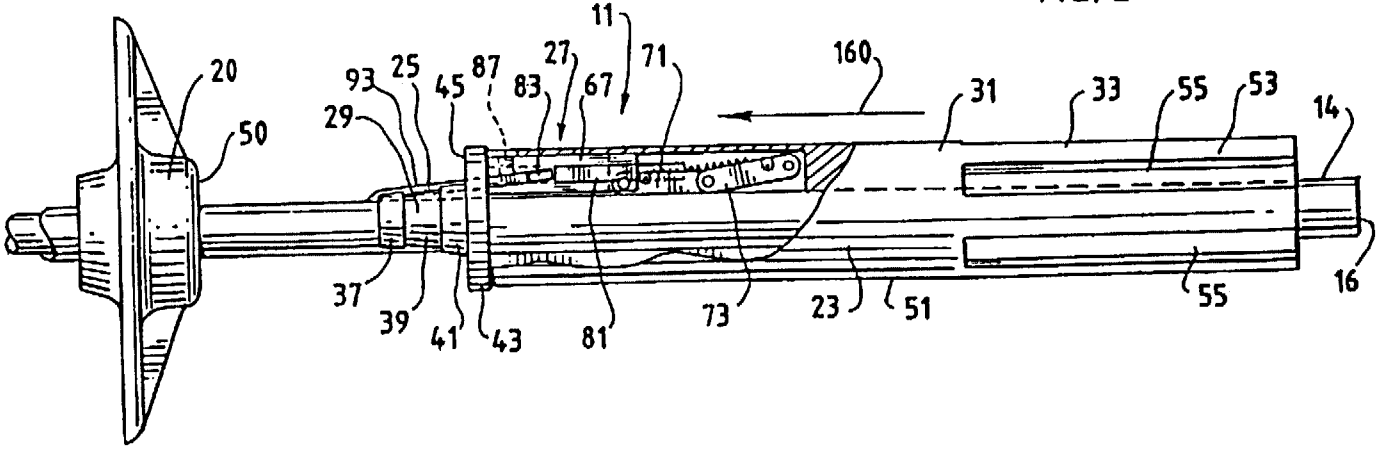
FIG. 2 is a side elevational view, partially in section of the device of FIG. 1 shown in a cutting position and mounted on the sheathed tendon.
Figure 3:
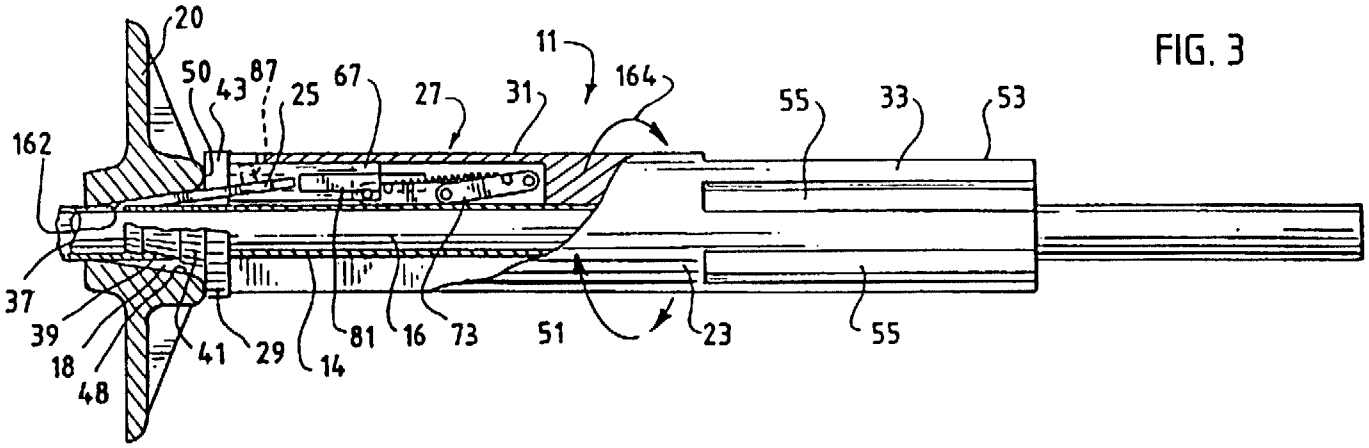
FIG. 3 is a view similar to FIG. 2, showing the device of FIG. 1 in an engaged cutting position.
Figures 7, 8, 9, 10:
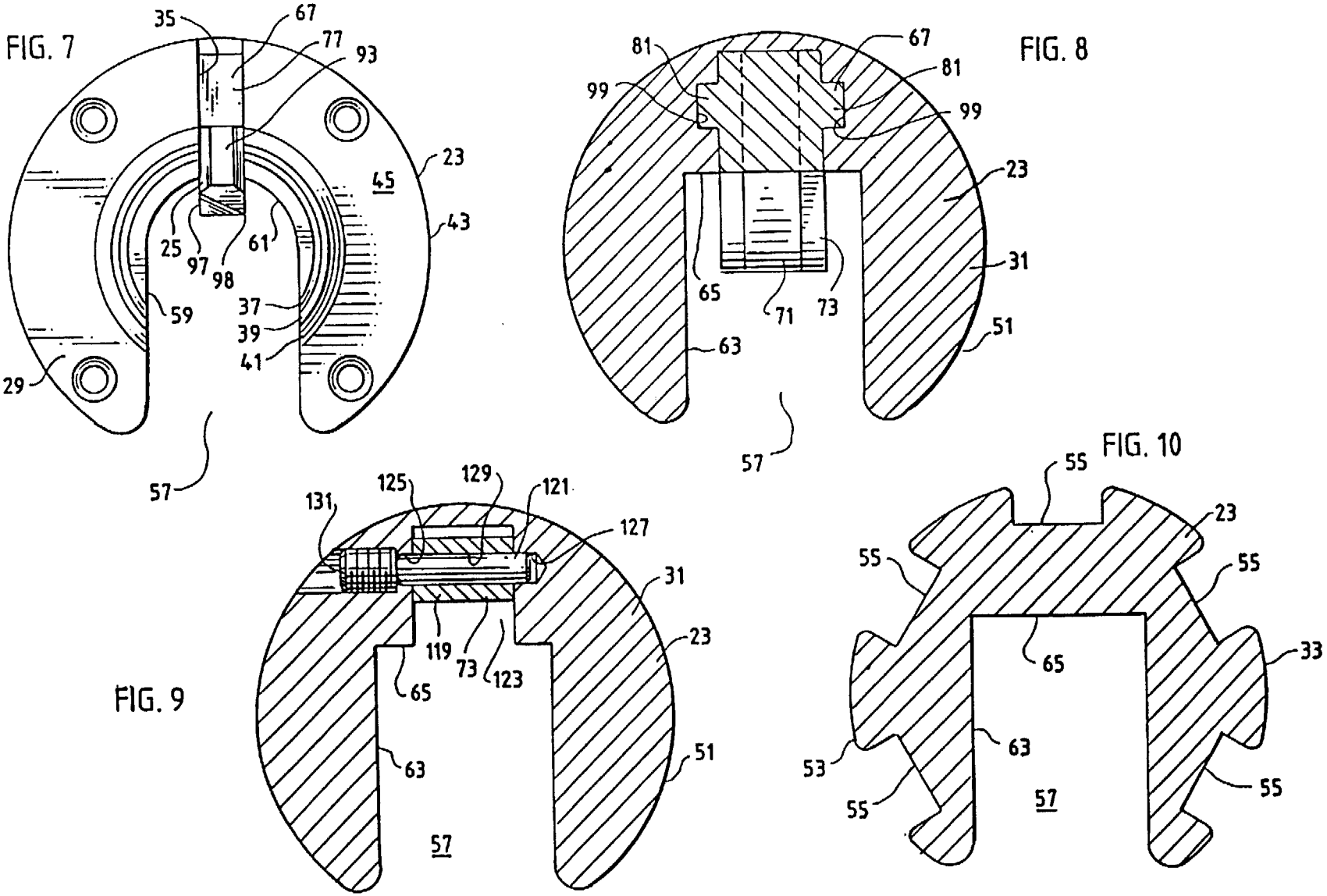
FIG. 7 is an enlarged end view of the device taken along the line 7—7 of FIG. 1.
FIG. 8 is an enlarged cross-sectional view of the device taken along the line 8—8 of FIG. 1.
FIG. 9 is an enlarged cross-sectional view of the device taken along the line 9—9 of FIG. 1.
FIG. 10 is an enlarged cross-sectional view of the device taken along the line 10—10 of FIG. 1.

With reference to FIGS. 1–4, the elongate housing 23 of the device 11 includes a substantially conical forward end portion 29, and substantially cylindrical main and rear portions 31 and 33, respectively. With reference to FIG. 7, the forward end portion 29 has a slot 35 through which the blade 25 extends. With particular reference to FIGS. 5 and 7, the forward end portion 29 includes outer surfaces 37, 39 and 41, each of which are substantially tapered or conical in shape, and a collar 43, having a substantially flat surface 45 integral with the surface 41. With reference to FIG. 3, the forward end portion 29 is designed to cooperate with the anchor assembly 20 so that the outer surfaces 37 and 41 contact an inner, conical surface or wall 48 which defines the wedge cavity 18 of the anchor assembly 20 and the flat surface 45 abuts an end 50 of the anchor assembly 20 when the device 11 is in a cutting position, placing the housing 23 in substantial coaxial alignment with the tendon 16.

The forward portion 29 is attached to the main portion 31 of the housing 23 at the collar 43. The main portion 31 has a substantially cylindrical outer surface 51 and is integral with the rear housing portion 33 which has an outer surface 53. The outer surface 53 includes longitudinal grooves 55 which aid a user in gripping the device 11 during the operation thereof.

With reference to FIGS. 7–10, the forward, main and rear portions, 29, 31 and 33 respectively, of the housing 23 are hollow and include surfaces defining a slot or opening 57 having a width greater than a diameter of a sheathed tendon 16 to be cut by the device 11. As illustrated in FIG. 7, an inner surface 59 of the forward tapered portion 29 of the housing 23 is substantially U-shaped, a curved portion 61 of which has a radius of curvature slightly larger than the radius of a tendon 16 when encased by sheathing 14. As illustrated by FIGS. 8–10, the main and rear portions, 31 and 33 respectively, have an inner surface 63 which is substantially rectangular in shape and includes a substantially flat contact surface 65 adapted to abut against the sheathing 14 of a tendon 16.

Figure 6:
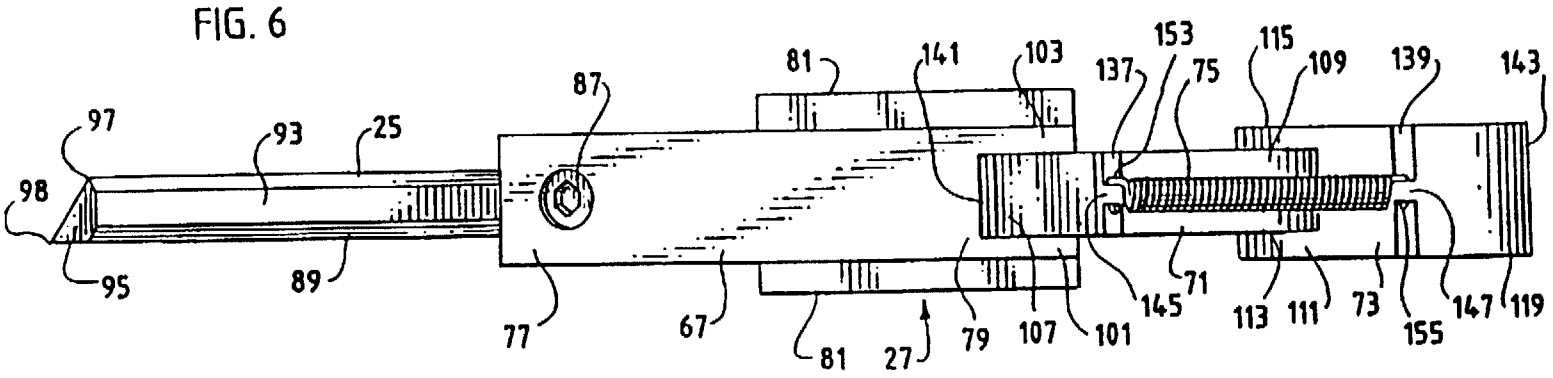
FIG. 6 is an enlarged top plan view of the blade holding and extending mechanism of FIG. 5.

With particular reference to FIGS. 5 and 6, the blade holding and extending mechanism 27 is disposed within the main housing portion 31. The mechanism 27 generally comprises a block-like blade holder 67, first and second hinged arms, 71 and 73 respectively, and a tension spring 75 suspended therebetween.

The blade holder 67 includes a front portion 77, a rear portion 79 and lateral flanges 81 integral with the rear portion 79. The front portion 77 has a cavity 83 which receives the blade 25 and a threaded bore 85 which receives a hexagon socket head set screw 87 that abuts and holds the blade 25 in place within the cavity 83.

With reference to FIGS. 5, 6 and 7, the blade 25 includes an elongate body 89 having a back end 91, an upper surface 93, a forward end 95, a cutting edge 97, and a piercing point 98. The cavity 83 of the blade holder 67 is inclined with respect to the length of the main housing portion 31, orienting the blade body 89 in substantially the same direction as the tapered surfaces 37, 39 and 41 of the forward portion 29.

With reference to FIG. 8, the main housing portion 31 includes grooves 99, with the lateral flanges 81 of the blade holder 67 being slidably disposed therewithin. Thus, the blade holder 67 is held within the housing portion 31 and is slidable in a longitudinal direction with respect to the length of the housing 23.

With reference to FIGS. 5 and 6, the arm 71 is pivotally connected to the blade holder rear portion 79. The rear portion 79 includes two knuckles 101 and 103, each having a bore (not shown) through which a pin 105 is disposed. A forward portion 107 of the arm 71 is disposed between the knuckles 101 and 103 and also has a bore (not shown) through which the pin 105 is disposed.

The arm 71 includes a rear portion 109 which is hingedly connected to a front portion 111 of the arm 73. The front portion 111 of the arm 73 includes two knuckles 113 and 115, each having a bore (not shown) through which a pin 117 is disposed. The rear portion 109 of the arm 71 is disposed between the knuckles 113 and 115 and also has a bore (not shown) through which the pin 117 is disposed.

With reference to FIGS. 5, 6 and 9, the arm 73 includes a rear portion 119 which is pivotally connected to the housing main portion 31 by a pin 121. Specifically, the housing main portion 31 includes a cavity 123 within which the rear portion 119 is disposed. The pin 121 extends through bores 125 and 127 of the housing and a bore 129 of the rear portion 119. The pin 121 is held in position in the bores 125 and 127 of the housing 31 by a set screw 131 having a hexagon socket head.

With reference to FIGS. 5 and 6, each arm 71 and 73 has a slot 133 and 135, respectively, on a top surface thereof having a width greater than the diameter of the spring 75. Each arm 71 and 73 also includes a slot 137 and 139, respectively, oriented transversely to the slots 133 and 135 and located between the mid-point of the arm and an end 141, and 143, respectively thereof. Each arm 71 and 73 also includes a longitudinal bar 145 and 147, respectively, which extends transverse to the slot, and defines an aperture 149 and 151, respectively.

End loops 153 and 155 integral to the tension spring 75 extend through the apertures 149 and 151 respectively and hook about the bars 145 and 147 respectively, thereby connecting the spring 75 to the arms 71 and 73. The spring 75 biases the blade holder 67 in a direction toward the rear portion 33 of the housing 23.

The cutting device 11 may be made from suitable durable materials, such as hardened tool steel.

Prior to operating the device 11, the tendon 16 encased in the sheathing 14 is placed at the site of a structure (e.g. a concrete structure) and inserted through the anchor assembly 20. At an opposite end, the tendon 16 is affixed to a further anchorage mechanism (not shown) and the tendon 16 is tensioned to be out of slack. After the concrete or other hardening material is poured and allowed to harden, the sheathing 14 projecting beyond the anchor assembly 20 must be removed in order to expose the bare steel tendon 16 to allow tensioning of the tendon 16. The removal of the sheathing 14 may be accomplished with the device 11.

The device 11 is placed on the sheathed tendon 16 at a selected location desirably close to the anchor assembly 20 to ensure the removal of the sheathing 14 in close proximity to where the conical inner surface 48 of the anchor assembly 20 approaches the sheathed tendon 16. Removal of the sheathing at such a location results in suitable subsequent clamping of a tensioning mechanism (not shown) onto an unsheathed tendon or group of tendons and also ensures the appropriate frictional engagement between the unsheathed tendon and locking wedges placed between the tendon and the anchor assembly 20 after the desired tension is established.

The operation of the cutting device 11 is illustrated in FIGS. 1–4. With reference to FIGS. 1 and 2, the device 11 is positioned to a side of the tendon 16 with the tapered forward portion 29 of the device directed toward the anchor assembly 20 and the opening 57 (shown at FIG. 7) of the housing facing the tendon 16. At this point, the blade 25 is in a retracted position with the forward end of the blade 95 disposed within the forward tapered portion 29 of the housing 23. The blade holding and extending mechanism 27 is in a first, bent position with the spring 75 biasing the arm forward portion 107 of the arm 71 toward the rear portion 119 of the arm 73.

The device 11 is then moved toward the tendon 16 until the inner surfaces 59 and 63 partially surround the tendon 16 and the surface 65 abuts against the sheathing 14 of the tendon 16. As the device 11 is moved toward the sheathed tendon 16, the arm 71 contacts the sheathing 14 and the rear portion 109 thereof is moved toward the spring 75 pushing the forward portion 107 thereof in a longitudinal direction toward the forward housing portion 29. The arm 71 and the front portion 111 of the arm 73 contact the sheathing and are moved toward the main housing portion 31 and the flanges 81 slide in a forward direction in the grooves 99, thereby displacing the blade 25 in a forward direction so that the blade forward end 95 and a portion of the blade body 89 are disposed in the slot 35.

As illustrated in FIG. 2, when the housing contact surface 65 (shown in FIG. 9) abuts the sheathing 14 and the arms 71 and 73 are fully extended in a longitudinal direction, the spring 75 is disposed in the slots 133 and 135, and the blade holding and extending mechanism 27 is in a second, extended position. When the mechanism 27 is in this extended position, the blade 25 is in a selected cutting position with the blade body 89 disposed within the slot 35, the upper surface 93 thereof disposed outside of the outer surfaces 37, 39 and 41 of the housing portion 29 and the forward end 95 of the blade 25 and the piercing point 98 projecting forwardly from the forward tapered portion 29 toward the anchor assembly 20. When the blade 25 of the device 11 is in the cutting position, the cutting edge 97 is near or contiguous to the sheathing 14, but the point 98 does not pierce the sheathing 14.

The device 11 is then slid along the sheathed tendon 16 toward the anchor assembly 20 in a direction illustrated by an arrow 160 in FIG. 2 until the flat surface 45 of the collar 43 abuts the end 50 of the anchor assembly 20 as shown in FIG. 3. As the forward portion 29 of the housing 23 enters the wedge cavity 18 defined by the inner conical surface 48 of the anchor assembly 20, the upper surface 93 of the blade 25 contacts the conical surface 48, the forward end 95 of the blade 25 is deflected toward the sheathing 14 and the point 98 at the blade forward end 95 pierces the sheathing 14 at a selected location 162 deep within the wedge cavity 18 proximate to where the conical surface 48 is closest to or contacts the sheathing 14. When the blade point 98 is in this selected piercing location and the cutting edge 97 is thus in a selected cutting location, the outer surfaces 37 and 41 of the forward end portion 29 preferably are in full contact with the conical surface 48 of the anchor assembly 20 so that the device 11 is in substantial coaxial alignment with the tendon 16 assuring that the cutting edge 97 completely cuts the sheathing 14 and the sheathing 14 is severed from the tendon 16 when the device 11 is rotated thereabout. The device 11 is then rotated as illustrated by the arrow 164 in FIG. 3, with the cutting edge 97 slicing the sheathing 14 about a perimeter of the tendon 16.

Some anchor assemblies include an annular sealing member (not shown) disposed between the tendon 16 and the surface 48 at or near the location 162 where the surface 48 approaches the tendon 16. A device 11 according to the present invention may be designed to position the blade cutting edge 97 in a selected piercing/cutting position at a location near or contiguous to such a seal if desired.

Figure 4:
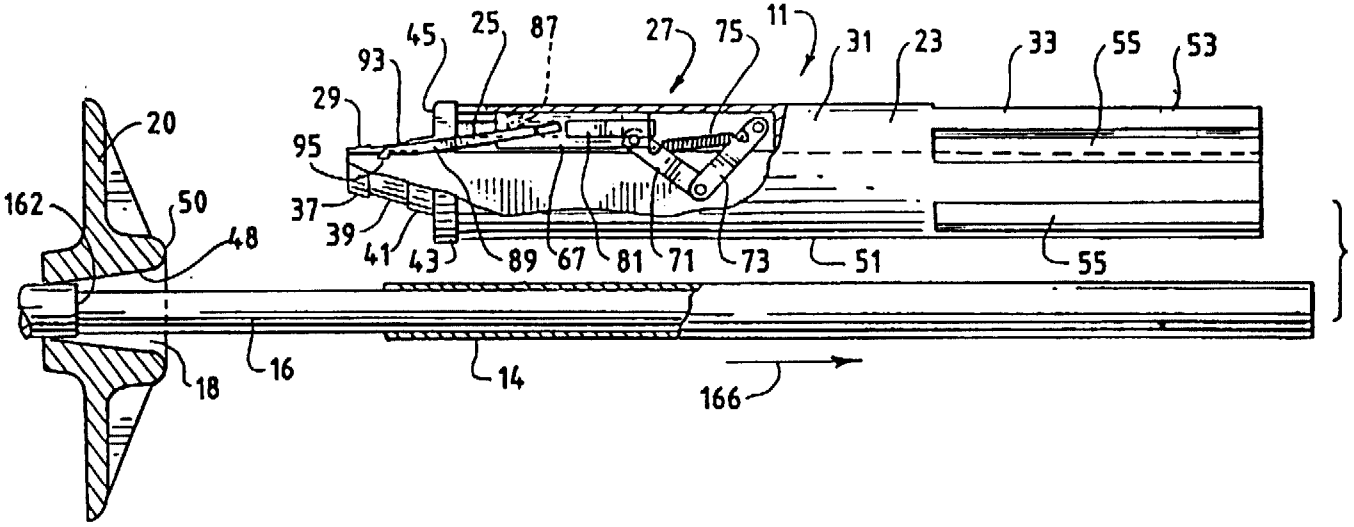
FIG. 4 is a view similar to FIG. 1, showing the device of FIG. 1 in a retracted position.
Figure 5:
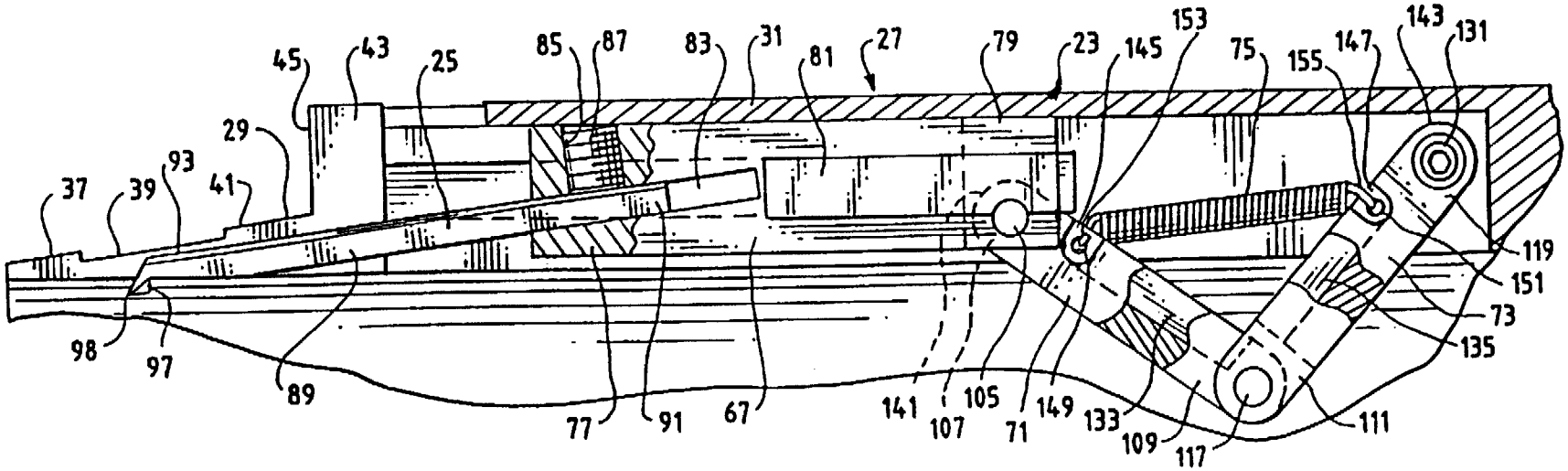
FIG. 5 is an enlarged side elevational view of the blade holding and extending mechanism portion of the device of FIG. 1 with portions removed to show the detail thereof.

After rotating the device 11 about the tendon 16, the device is moved in a direction illustrated by an arrow 166 in FIG. 4, allowing the blade edge 97 to return to its former position disengaged from the sheathing 14. The device 11 is then removed from the tendon 16. The spring 75 biases the arm portion 107 toward the arm portion 119, sliding the blade holder 67 in a rearward direction toward the housing rear portion 33 and positioning the blade 25 in the retracted position.

The sheathing 14 is then removed from the tendon 16 by sliding it in the direction of the arrow 166 in FIG. 4. and off the end of the tendon 16. The tendon 16 may then be tensioned and wedges lodged between the conical surface 48 and the tendon 16.

The cutting device and method according to the invention provide a fast, uncomplicated and efficient means for cutting sheathing from a tendon at a location within a cavity of an anchor assembly. This allows for excellent corrosion protection of the tendon because the sheathing protects the tendon until immediately prior to the tendon tensioning process. After tensioning, the sheathing may be placed back onto the tendon to provide further corrosion protection.

A device according to the invention advantageously cooperates with existing anchor bodies or assemblies which typically include conical inner walls by providing a blade which deflects toward and cuts the sheathing as it contacts the inner wall of an anchor body. However, the inventive device is not limited to the use of a cutting blade which deflects from a wall in order to cut the sheathing. For example, the device may be equipped with a blade oriented in a fixed position for use in anchor assemblies having large or non-conical wedge cavities.

Also, in some applications, the blade extending and retracting mechanism disclosed herein may not be required. Therefore, the invention should not be considered limited to the inclusion of such a mechanism.

Finally, although the invention has been described with respect to sheathed, single-strand tendons utilized to reinforce concrete structures, the invention should not be considered so limited as devices and methods according to the invention may be utilized for the severing of sheathing from a single- or multi-strand tendon in a variety of other applications including the strengthening of steel structures and for rock and soil anchors.

The foregoing detailed description is given for clearness of understanding only, and no unnecessary limitations should be understood therefrom, as modifications within the scope of the invention will be apparent to those skilled in the art.

We claim:

1. In combination:

(a) an anchor assembly for securing a tendon, the anchor assembly having an inner wall defining a cavity for passage of a sheathed tendon therethrough; and (b) a device for cutting the sheathing which envelops the tendon comprising:

(i) a housing mountable on a portion of the sheathed tendon in rotatable fashion;

(ii) a blade having a cutting edge; and (iii) means for securing the blade to the housing, said blade securing means being connected to the housing and fixed to the blade, the blade securing means placing the blade in a position in contact with the anchor assembly inner wall thereby deflecting the cutting edge toward the sheathed tendon into contact with the sheathing when the device is mounted on the sheathed tendon such that the cutting edge cuts the sheathing at a selected location within the cavity as the housing is rotated about the sheathed tendon.

2. The device of claim 1 wherein the housing has an inner surface defining an opening, the inner surface partially surrounding the sheathed tendon when the device is mounted thereon.

3. The device of claim 2 wherein the housing comprises a forward portion having a conical outer surface, the conical surface contacting the anchor assembly inner wall to provide coaxial alignment between the housing sheathed and the tendon when the device is mounted on the sheathed tendon.

4. The device of claim 3 wherein the housing comprises a substantially cylindrical portion attached to the forward portion, the blade securing means being disposed within the cylindrical portion.

5. The device of claim 1 wherein the blade securing means is a blade holding and extending mechanism having first and second positions wherein when the blade holding and extending mechanism is in the first position, the blade cutting edge is disposed within the housing and when the blade holding and extending mechanism is in the second position, the blade cutting edge extends outside of the housing in a selected cutting position.

6. The device of claim 5 wherein the housing comprises a forward portion having a slot through which the blade extends when the mechanism is in the second position.

7. The device of claim 5 wherein the mechanism is in the second position when the device is mounted on the sheathed tendon, the mechanism automatically converting from the second position to the first position by contraction of a spring attached to the mechanism when the device is removed from the sheathed tendon.

8. The device of claim 5 wherein the mechanism comprises first and second arms connected by a tension spring, the spring biasing the first arm toward the second arm, the first arm pivotally attached to the housing, the second arm pivotally attached to the first arm and pivotally attached to a blade holder slidingly mounted within the housing, the blade being fixed to the blade holder.

9. The device of claim 8 wherein at least one of the first and second arms abuts the sheathed tendon expanding the spring and displacing the blade to the selected cutting position when the blade holding and extending mechanism is in the second position.

10. The device of claim 8 wherein the blade holder comprises first and second flanges and the housing has first and second grooves, the first and second flanges slidingly disposed within the first and second grooves, respectively.

11. In combination:

(a) an anchor assembly for securing a tendon, the anchor assembly having an inner wall defining a cavity for passage of a sheathed tendon therethrough; and (b) a device for cutting the sheathing which envelops the sheathed tendon comprising:

(i) a substantially cylindrical housing for mounting on a portion of the sheathed tendon in rotatable fashion, said housing having an inner surface defining an opening, the inner surface partially surrounding the sheathed tendon when the device is mounted thereon;

(ii) an elongate blade having a surface and a cutting edge; and (iii) a blade holding and extending mechanism mounted within the housing and fixed to the blade, the mechanism having a first position wherein the blade cutting edge is disposed within the housing and a second position wherein the blade cutting edge extends outside of the housing and is in a selected cutting position, the mechanism being in the second position and disposed relative to the blade such that when the device is mounted on the sheathed tendon and the housing abuts the anchor assembly, the blade surface contacts the anchor assembly inner wall and deflects the cutting edge toward the sheathed tendon into contact with the sheathing, the cutting edge cutting the sheathing at a selected location within the cavity as the housing is rotated about the sheathed tendon.

12. The device of claim 11 wherein the housing comprises a forward portion having an outer surface and a slot, the outer surface contacting the anchor assembly inner wall providing coaxial alignment between the housing and the sheathed tendon and the blade extending through the slot when the device is mounted on the sheathed tendon.

13. The device of claim 11 wherein the mechanism automatically converts from the second position to the first position by contraction of a spring attached to the mechanism when the sheathed device is removed from the tendon.

14. The device of claim 11 wherein the mechanism comprises first and second arms connected by a tension spring, the spring biasing the first arm toward the second arm, the first arm pivotally attached to the housing, the second arm pivotally attached to the first arm and pivotally attached to a blade holder slidingly mounted on the housing, the blade being fixed to the blade holder.

15. The device of claim 14 wherein at least one of the first and second arms abuts the sheathed tendon expanding the spring and displacing the blade to the selected cutting position when the mechanism is in the second position.

16. The device of claim 14 wherein the blade holder comprises first and second flanges and the housing has first and second grooves, the first and second flanges slidingly disposed within the first and second grooves, respectively.

* * * * *